US005688746A

United States Patent [19]

Thacker

[11] Patent Number: 5,688,746

[45] Date of Patent: Nov. 18, 1997

[54] RATITE OIL LUBRICANT COMPOSITIONS

[75] Inventor: Kathryn M. Thacker, Sumner, Ill.

[73] Assignee: Kaddreco, Inc., Mount Vernon, Ind.

[21] Appl. No.: 695,358

[22] Filed: Aug. 9, 1996

[51] Int. Cl.[6] ..... C10M 101/04; C10M 129/00

[52] U.S. Cl. ..... 508/101

[58] Field of Search ..... 508/101

[56] References Cited

U.S. PATENT DOCUMENTS 5,397,263 3/1995 Schumann et al. .

5,405,289 4/1995 Schumann et al. .

5,431,924 7/1995 Ghosh et al. ..... 424/522

5,464,548 11/1995 Cahoon et al. .

5,472,713 12/1995 Fein et al. ..... 424/522

*Primary Examiner*—Jacqueline V. Howard

*Attorney, Agent, or Firm*—McDermott, Will & Emery

[57] ABSTRACT

Lubricant and grease compositions are disclosed comprising ratite oils. These lubricant and grease compositions include compositions comprising a major amount of an oil of lubricating viscosity, and a minor amount of ratite oil. The lubricating and grease compositions are useful as lubricants, friction reducers, and coolants.

10 Claims, No Drawings

RATITE OIL LUBRICANT COMPOSITIONS

FIELD OF THE INVENTION

This invention relates to lubricant compositions and methods of making and using such lubricant compositions. More particularly, the invention relates to lubricating and grease compositions comprising ratite oils.

BACKGROUND OF THE INVENTION

Ratites are a family of flightless birds having undeveloped wings and a flat breastbone without the keellike prominence characteristic of most flying birds. The ratite family of birds includes ostriches, emus, rheas, kiwis and cassowaries.

Currently, ratites are bred for their meat, which is quite similar to beef but lower in cholesterol. Ratites are also bred for their hides which are similar to leather. The rest of the ratite by-products are often discarded. Therefore, it would be desirable to provide other uses of ratite by-products.

Emu and rhea oils have been used in cosmetics, anti-inflammatory pharmaceutical compositions, and for decreasing low density lipoproteins to treat various ailments. For example, in U.S. Pat. No. 5,472,713, a method of decreasing low density lipoproteins is described in which an effective amount of emu oil is administered to a patient. This method is described as useful in treating scarring, headaches, nose bleeds, cold and flu symptoms, etc. In U.S. Pat. No. 5,431,924, a biologically active yellow-colored component of emu oil is disclosed. This biologically active component of emu is used as an anti-inflammatory pharmaceutical composition. Other examples of ratite oils used for treatment of skin, joints, pain, burns and wounds include Kelaya® Oil from New World Technology, Inc., Dix Hills, N.Y., and "Rhoil"—rhea oil from Ray Williams, Alexander, Ark.

Lubricating and grease compositions are used to provide a layer of lubricant between surfaces such as metal surfaces which are moving against one another. The lubricating and grease compositions help prevent harmful friction, heat and wear to the surfaces by reducing friction and temperature.

Many lubricating and grease compositions are manufactured using harmful chemicals which are not desirable for human inhalation or exposure. These lubricants may also present environmental problems regarding disposal of waste products. Therefore, it would be desirable to provide lubricating and grease compositions which are environmentally acceptable and harmless to humans.

I have found that compositions comprising ratite oils provide excellent lubricating and grease compositions. These compositions are useful in preventing friction, heat and wear between surfaces such as metal surfaces for various industrial, commercial and household applications. The ratite oil lubricant compositions of the invention provide advantages over prior lubricating compositions because they do not create environmental or health hazards.

SUMMARY OF THE INVENTION

The invention comprises methods of lubricating two surfaces moving against one another to reduce friction, heat or wear comprising treating at least one of the surfaces with a lubricant and grease composition comprising a ratite oil. The invention further comprises lubricant and grease compositions comprising an oil of lubricating viscosity and a ratite oil. The invention further comprises compositions comprising a major amount of an oil of lubricating viscosity, and a minor amount of a ratite oil.

DETAILED DESCRIPTION OF THE INVENTION

As used herein, "ratite oil" refers to oils derived from birds of the ratite family, including derivatives or synthetic forms thereof, and mixtures thereof. As used herein, "an oil of lubricating viscosity" refers to a non-ratite, natural or synthetic lubricating oil or mixture thereof, including cutting oils, gear oils and hydraulic fluids. These oils further include automatic transmission fluids, transaxle lubricants, tractor lubricants, metal-working lubricants, crankcase lubricating oils for spark-ignited and compression-ignited internal combustion engines, including automobile, tractor and truck engines, two-cycle engines, aviation piston engines, and marine and railroad diesel engines. They also include non-ratite oils used in gas engines, stationary power engines, and turbines, and other lubricating oil and grease compositions. Preferably, the oil of lubricating viscosity used in the ratite oil lubricant compositions of the present invention is selected from the group consisting of cutting oils, gear oils, hydraulic fluids, and mixtures thereof.

The lubricant compositions of the invention are especially useful in reducing or preventing friction, heat and wear when used to treat at least one surface of two surfaces moving against one another, such as metal surfaces for various industrial, commercial and household applications. The ratite oils useful in the compositions and methods of the invention comprise ostrich, emu, rhea, kiwi and cassowary oils, derivatives of such oils and synthetic forms of such oils. Ostrich, emu and rhea are the preferred ratite oils of the invention and have the following properties:

Emu Oil

Description: semi-solid white mass; clear, yellow in liquid phase
Boiling Point: >150° C.
Specific Gravity: 0.9458
Solubility: insoluble in water
Flashpoint: >140° C.
Water Content: <0.1%
Health Effects: edible, foodgrade oil; non-irritant to mucous membranes and most skin types; no inhalation hazard

Ostrich Oil

Description: semi-solid white mass; light yellow-colored material in liquid phase
Boiling Point: >320° C.
Specific Gravity: 1.1
Water Solubility: 0.009% at 20° C.
Flashpoint: >312° C.
Water Content: <0.04%
Health Effects: edible, foodgrade oil; non-irritant to mucous membranes and most skin types; no inhalation hazard

Rhea Oil

Description: semi-solid white mass; light yellow-colored material in liquid phase
Boiling Point: >320° C.
Specific Gravity: 1.2
Solubility: 0.015% at 20° C.
Flashpoint: >312° C.
Water Content: <0.02%
Health Effects: edible, foodgrade oil; non-irritant to mucous membranes and most skin types; no inhalation hazard The ratite oil lubricant compositions of the invention are useful as additives for lubricants for antiwear, antiweld, extreme pressure, anticorrosion, antioxidation and/or friction modifying agents. They can be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile, tractor and truck engines, two-cycle engines, aviation piston engines, and marine and railroad diesel engines. They can also be used in gas engines, stationary power engines, and turbines. The ratite oil lubricant compositions can also be incorporated into automatic transmission fluids, transaxle lubricants, gear lubricants, tractor lubricants, metal-working lubricants, hydraulic fluids and other lubricating oil and grease compositions.

The ratite oil lubricant compositions may be used in lubricants or in concentrates. The concentrate contains the ratite oil lubricant compositions alone or in combination with other components used in preparing fully formulated lubricants. Such fully formulated lubricants are described in U.S. Pat. No. 5,464,548, which is incorporated by reference herein. The concentrate may also contain a substantially inert organic diluent, which includes kerosenes, mineral distillates, or one or more of the oils of lubricating viscosity discussed herein. In one embodiment, the concentrate contains from about 25% to about 100% by weight of a ratite oil. In another embodiment, when the ratite oil lubricant compositions are used in oils such as cutting oils, gear oils, or hydraulic fluids, they are preferably present in an amount from about 0.01% to about 10% by weight of the lubricating composition.

The ratite oil lubricant compositions are useful as concentrates or additives for petroleum and oil-based products such as cutting oils, lubricants, coolants, motor oils, hydraulic fluids, gear oils, gun grease, cleaners, oil-based paints, fuel and fuel additives, insect repellants, automotive waxes, polishes and protectants, furniture polishes and cleaners, lamp oils, and crop oils.

The following describes the preparation of rhea oil for use in the compositions and methods of the invention. Alternative methods for slaughtering ratites and obtaining oil from ratites are also described in U.S. Pat. Nos. 5,472,713, 5,405,289, and 5,397,263, incorporated by reference herein.

A rhea was slaughtered, the blood was drained, and the skin with feathers was removed. Next, the bird was cut open on the breast side and the internal organs were removed. Any fat present on the inside of the rhea was saved. The recovered fat was mainly from the thick blanket of fat under the skin attached to the back of the bird against the muscle tissue.

Next, the fat was cut into small pieces, placed in a heatable container such as a metal pan, and heated over medium heat to a light yellow-colored liquid oil phase. Solid materials which floated to the top were then filtered out. The rhea oil was then poured into suitable containers such as plastic jars for storage.

The following examples illustrate preferred embodiments of ratite oil lubricant and grease compositions.

Example 1

A ratite oil lubricant composition comprising rhea oil was prepared as follows. A mixture comprising approximately 2 tbsp (approximately 29.5 ml) of rhea oil and approximately 1 quart (approximately 0.95 liter) of thread cutting oil, Pennzoil-Pennzkat® A-18, was prepared. This mixture was used as a lubricant composition in place of thread cutting oil alone in an Amba-Aachener #570, Germany, flat die machine for the production of bicycle spokes.

The ratite oil lubricant composition resulted in an excellent reduction in friction and heat in the thread die used in operation of the spoke machinery when compared to thread cutting oil alone. The bicycle spokes made in this spoke machine were cooler as they came off the die and had less cross threads due to reduced friction and temperature. Also, use of the ratite oil lubricant composition resulted in less damage to the machine operator's hands, including elimination of blistering and staining from hot metal shavings due to reduced friction from the die and cooler temperature of the spokes. Further, the use of the ratite oil lubricant composition resulted in reduced odor in machinery operation.

Thread dies in the spoke machine operated using the ratite oil lubricant composition operated for much longer and were trouble-free compared to machines operated with thread cutting oil alone. A thread die which had been given four turns or used on four sides of the die in the bicycle spoke machine was expected to produce about 200,000 spokes before the thread die would have to be removed and replaced. It was surprisingly found that when using the ratite oil lubricant composition, the thread die produced over 750,000 spokes. Further, the time taken to turn the die was greatly reduced (approximately 15 min. to turn the die when the ratite oil lubricant composition was used compared to 2 hrs. when thread cutting oil alone was used). Thus, use of the ratite oil lubricant composition resulted in a savings in the time in which the spoke machines were not in operation.

Example 2

A ratite oil lubricant composition comprising emu oil and thread cutting oil is prepared as described in Example 1. This composition is used as a lubricant composition in place of thread cutting oil alone in a machine for the production of bicycle spokes as described in Example 1.

This ratite oil lubricant composition results in an excellent reduction in friction and heat in the die used in operation of bicycle spoke machinery (Example 1) when compared to thread cutting oil alone.

Example 3

A ratite oil lubricant composition comprising ostrich oil and thread cutting oil is prepared as described in Example 1. This composition is used as a lubricant composition in place of thread cutting oil alone in a machine for the production of bicycle spokes (Example 1).

This ratite oil lubricant composition results in an excellent reduction in friction and heat in the die used in operation of bicycle spoke machinery (Example 1) when compared to thread cutting oil alone.

The embodiments of the invention disclosed herein have been discussed for the purpose of familiarizing the reader with novel aspects of the invention. Although preferred embodiments of the invention have been shown and described, many changes, modifications, and substitutions may be made by one having skill in the art without necessarily departing from the spirit and scope of the invention.

I claim:

1. A lubricant composition comprising: (a) a ratite oil; and (b) an oil of lubricating viscosity selected from the group consisting of cutting oils, gear oils, hydraulic fluid oils, oils used in gas engines, stationary power engines, and turbines, automatic transmission fluids, transaxle lubricants, tractor lubricants, metal-working lubricants, crankcase lubricating oils for spark-ignited and compression-ignited internal combustion engines, including automobile, tractor and truck engines, two-cycle engines, aviation piston engines, and marine and railroad diesel engines, and mixtures thereof.

2. The lubricant composition of claim 1 wherein said ratite oil is selected from the group consisting of ostrich, emu, rhea, kiwi and cassowary oils, and mixtures thereof.

3. The lubricant composition of claim 1 wherein said ratite oil comprises from about 25% to about 99% by weight of said lubricant composition.

4. A lubricant composition comprising an oil of lubricating viscosity and a ratite oil wherein said ratite oil comprises from about 0.01% to about 25% by weight of said lubricant composition.

5. A method of preparing a lubricant composition comprising mixing: (a) an oil of lubricating viscosity selected from the group consisting of cutting oils, gear oils, hydraulic fluid oils, oils used in gas engines, stationary power engines, and turbines, automatic transmission fluids, transaxle lubricants, tractor lubricants, metal-working lubricants, crankcase lubricating oils for spark-ignited and compression-ignited internal combustion engines, including automobile, tractor and truck engines, two-cycle engines, aviation piston engines, and marine and railroad diesel engines and mixtures thereof; and (b) a ratite oil.

6. A method of lubricating two surfaces moving against one another to reduce friction, heat or wear comprising treating at least one of said surfaces with a lubricant composition comprising a ratite oil.

7. The method of claim 6 wherein said ratite oil is selected from the group consisting of ostrich, emu, rhea, kiwi and cassowary oils, and mixtures thereof.

8. The method of claim 6 wherein said ratite oil comprises from about 25% to about 99% by weight of said lubricant composition.

9. The method of claim 6 wherein said ratite oil comprises from about 0.01% to about 25% by weight of said lubricant composition.

10. A method of preparing a lubricant composition comprising mixing: (a) an oil for lubricating viscosity; and (b) about 0.01% to about 25% by weight of a ratite oil.

* * * * *